US005322058A

United States Patent [19]

Pasternack

[11] Patent Number: 5,322,058

[45] Date of Patent: Jun. 21, 1994

[54] GAS MASK AND BREATHING EQUIPMENT WITH RESPIRATION AIR RECIRCULATION

[75] Inventor: Adalbert Pasternack, Bad Schwartau, Fed. Rep. of Germany

[73] Assignee: Dragerwerk AG, Lübeck, Fed. Rep. of Germany

[21] Appl. No.: 16,120

[22] Filed: Feb. 10, 1993

[30] Foreign Application Priority Data

May 10, 1992 [DE] Fed. Rep. of Germany ..... 4207533

[51] Int. Cl.[5] ..... A62B 7/10

[52] U.S. Cl. ..... 128/204.28; 128/204.22; 128/204.26; 128/205.17; 128/205.28

[58] Field of Search ..... 128/204.22, 204.26, 128/204.28, 205.17, 205.24, 205.28, 207.12, 203.12, 910, 205.27, 206.12, 206.15

[56] References Cited

U.S. PATENT DOCUMENTS

| | | | |
|---|---|---|---|
| 3,575,167 | 4/1971 | Michielsen | 128/205.28 |
| 3,695,261 | 10/1972 | Emmons | 128/204.22 |
| 4,188,946 | 2/1980 | Watson | 128/204.22 |
| 4,423,723 | 1/1984 | Winkler | 128/202.22 |
| 4,430,995 | 2/1984 | Hilton | 128/204.21 |
| 4,440,164 | 4/1984 | Werjefect | 128/205.25 |
| 4,974,585 | 12/1990 | Stone | 128/205.12 |
| 5,119,810 | 6/1992 | Kiske et al. | 128/204.26 |
| 5,237,990 | 8/1993 | Psaros et al. | 128/204.21 |

FOREIGN PATENT DOCUMENTS

0066451B1 5/1982 European Pat. Off. ..... 128/204.21

*Primary Examiner*—Edgar S. Burr
*Assistant Examiner*—Eric P. Raciti
*Attorney, Agent, or Firm*—McGlew and Tuttle

[57] ABSTRACT

A gas mask and breathing equipment with a breathing mask with a respiration gas outlet and a respiration gas inlet, to which a breathing bag as well as a filter and a fan are connected. The fan is designed to deliver ambient air through the filter and into the breathing mask. A volume sensor is arranged on the breathing bag and is connected to a fan control to reduce the delivery output of the fan with increasing volume of the breathing bag. So that only the absolutely necessary amount of ambient air will have to be delivered through the filter, an air distributing valve (12), is controlled via a valve control means (17) and an actuator (14) as a function of the signal of a carbon dioxide sensor connected to the respiration gas inlet (2). The exhaled air is directed from the respiration gas outlet (3) predominantly into the environment when the carbon dioxide content is above a predeterminable limit value, and predominantly into the breathing bag (7) when the carbon dioxide content is below the limit value.

4 Claims, 1 Drawing Sheet

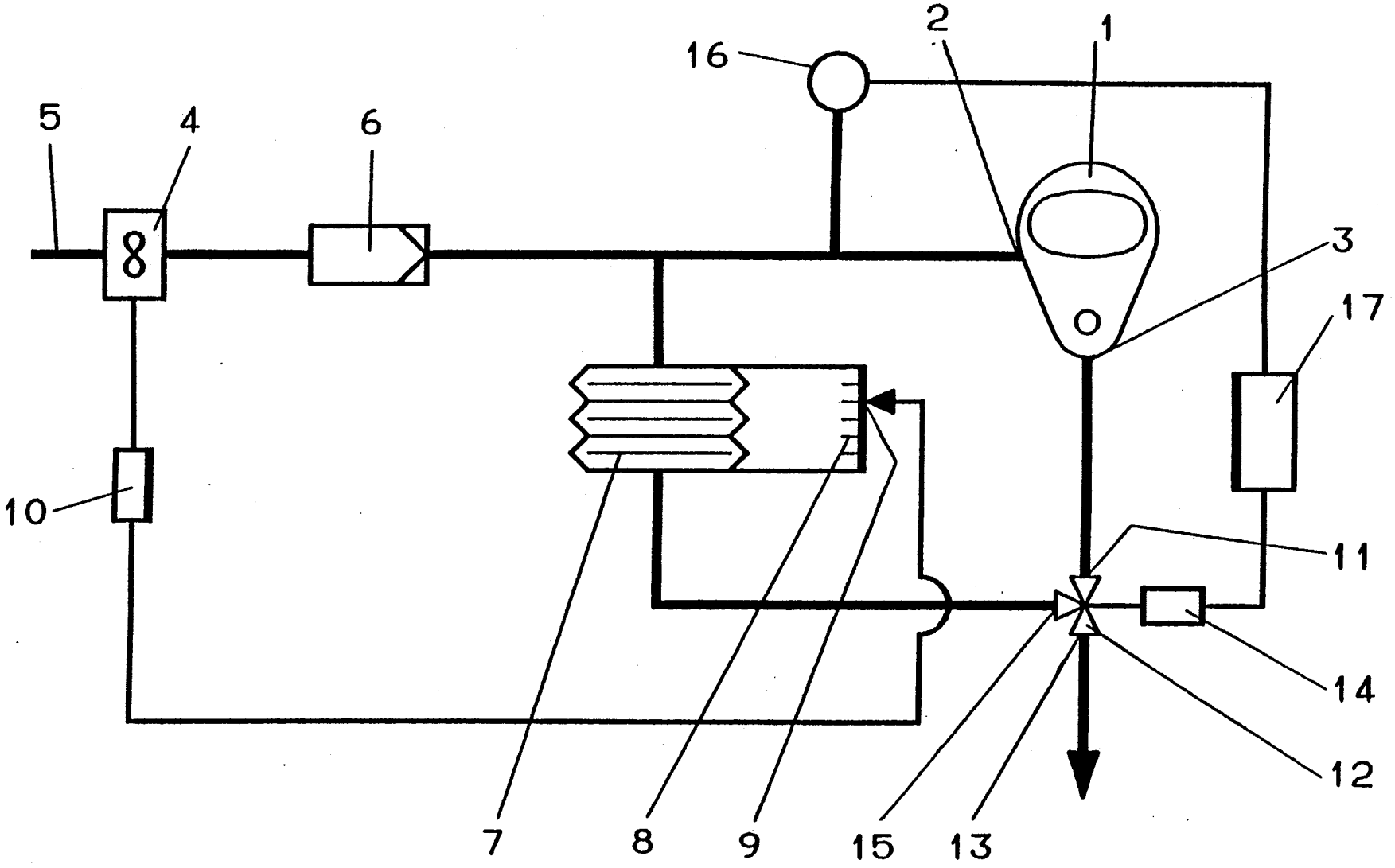
1
2
3
4
5
6
7
8
9
10
11
12
13
14
15
16
17

GAS MASK AND BREATHING EQUIPMENT WITH RESPIRATION AIR RECIRCULATION

FIELD OF THE INVENTION

The present invention pertains to a gas mask and breathing equipment with a breathing mask with respiration gas outlet and a respiration gas inlet, to which a breathing bag as well as a filter and a fan are connected, wherein the fan is designed to deliver ambient air through the filter and into the breathing mask, and wherein a volume sensor connected to a fan control means designed to reduce the delivery output of the fan with increasing volume of the breathing bag is arranged on the breathing bag.

BACKGROUND OF THE INVENTION

Such a gas mask and breathing equipment has become known from European Patent Office Publication EP-PS 66,451.

In the prior-art gas mask and breathing equipment, the delivery output of the fan is limited to the extent necessary for breathing in order to save energy and to protect the filter by not delivering a needlessly large amount of air through it. The disadvantage of this prior-art gas mask and breathing equipment is the fact that not all the possibilities available for saving energy and protecting the filter are utilized.

SUMMARY AND OBJECTS OF THE INVENTION

It is an object of the present invention to improve a gas mask and breathing equipment of the type described such that only the absolutely necessary amount of ambient air will have to be delivered through the filter. The improvement is achieved in that an air distributing valve, controlled via a valve control means and an actuator as a function of the signal of a carbon dioxide sensor connected to the respiration gas inlet, is intended to direct the exhaled air from the respiration gas outlet predominantly into the environment when the carbon dioxide content in the inhaled air is above a predeterminable limit value, and predominantly into the breathing bag when the carbon dioxide content is below the limit value.

The advantage of the present invention is that by recirculating part of the exhaled air, the filter can be optimally protected, and the energy consumption of the fan can be minimized. The gas mask and breathing equipment is regulated via a carbon dioxide sensor such that the maximum allowable carbon dioxide content in the inhaled air will never be exceeded.

The air distributing valve may be designed as a standard 3/2-directional valve with, e.g., electromagnetic actuation, but it may also be designed such that the distribution of the air between the two directions can be influenced continuously.

A further object of the invention is to provide a gas mask and breathing equipment arrangement which is simple and dependable in design, durable in operation and economical in use.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only Figure is a schematic view showing the gas mask, breathing equipment and respiration air recirculation arrangement according to the invention.

DETAILED DESCRIPTION OF THE PREFERRED EMBODIMENT

The present invention will be explained on the basis of an example and the drawing. The only figure shows a gas mask and breathing equipment with a breathing mask 1, which has a respiration gas inlet 2 and a respiration gas outlet 3. A fan 4 draws in ambient air at its suction pipe connection 5, and delivers it through a filter 6, in which undesired impurities are filtered out, and into the respiration gas inlet 2 of the breathing mask 1. A breathing bag 7 is also connected to the respiration gas inlet 2. This breathing bag 7 is used as a buffer volume, so that the delivery output of the fan 4 needs to be designed only to the average respiration gas flow rather than to its peak value.

A volume sensor in the form of a potentiometer 8 is connected to the breathing bag 7. The sliding contact 9 of the potentiometer 8 is connected to a fan control means 10, which adjusts the delivery output of the fan 4 to a maximum when the breathing bag 7 is empty, and to a minimum when the breathing bag 7 is full.

A mask connection 11 of a 3/2-directional valve used as an air distributing valve 12 is connected to the respiration gas outlet 3 of the breathing mask 1. The first direction of the air distributing valve 12 leads from the mask connection 11 to an ambient air connection 13, which opens into the environment. The air distributing valve 12 can be switched over from the first direction described to a second direction by means of an electromagnetic actuator 14. The second direction directs the respiration gas from the mask connection 11 to a breathing bag connection 15, which is connected to the breathing bag 7.

A carbon dioxide sensor 16 is connected to the respiration gas inlet 2 of the breathing mask 1. Its signal is sent to a valve control means 17, which controls the air distributing valve 12 varying the distribution via the actuator 14.

If the carbon dioxide content in the inhaled air is above a predeterminable limit value, the valve control means 17 switches the air distributing valve 12 to the first direction, as a result of which the exhaled air is discharged into the environment. If the carbon dioxide content in the inhaled air is below the limit value, the valve control means 17 switches the air distributing valve 12 over to the second direction, as a result of which the exhaled air enters the breathing bag 7 and is returned from there into the breathing mask 1 during the next breath.

The carbon dioxide content in the inhaled air is thus maintained at a permissible level, as a result of which a maximum of the exhaled air is reused. This considerably reduces the load on the fan 4 and the filter 6. The service life of the filter 6 and of a battery used to supply current will increase.

While a specific embodiment of the invention has been shown and described in detail to illustrate the application of the principles of the invention, it will be understood that the invention may be embodied otherwise without departing from such principles.

What is claimed is:

1. Gas mask and breathing equipment arrangement, comprising:

a breathing mask with a respiration gas outlet and a respiration gas inlet;

a filter and fan connected to said respiration gas inlet, said fan delivering ambient air through said filter and into said breathing mask;

a breathing bag connected to said respiration gas inlet;

a volume sensor arranged on said breathing bag;

and means for saving energy and protecting said filter including;

fan control means for reducing a delivery output of said fan with increasing volume of said breathing bag, said fan control means being connected to said volume sensor and connected to said fan, an air distributing valve having a connection to said respiration gas outlet, having a connection to said breathing bag and having a respiration equipment outlet to the environment, carbon dioxide sensor means connected to said respiration gas inlet for sensing carbon dioxide content of gas at said respiration gas inlet, and valve control means connected to said carbon dioxide sensor and including an actuator connected to said air distributing valve said valve control means for controlling said air distributing valve to direct exhaled air from said respiration gas outlet to the environment when a carbon dioxide content in inhaled air at said respiration gas inlet is above a predeterminable limit value and to direct exhaled air from said respiration gas outlet to said breathing bag when said carbon dioxide content is below said limit value.

2. Gas mask and breathing equipment according to claim 1, wherein:

said air distributing valve varies a distribution of exhaled air between the environment and the breathing bag.

3. Gas mask and breathing equipment according to claim 1, wherein:

said air distributing valve is provided with two switching positions, a first switching position for directing exhaled air into the environment, and a second switching position for directing exhaled air into the breathing bag.

4. Gas mask and breathing equipment arrangement, comprising:

a breathing mask with a respiration gas outlet and a respiration gas inlet; a filter and fan connected to said respiration gas inlet, said fan delivering ambient air through said filter and into said breathing mask;

a breathing bag having an outlet connected directly to said respiration gas inlet;

a volume sensor arranged on said breathing bag;

and means for saving energy and protecting said filter including;

fan control means for reducing a delivery output of said fan with increasing volume of said breathing bag, said fan control means being connected to said volume sensor and connected to said fan, an air distributing valve having a connection to said respiration gas outlet, having a connection to said breathing bag and having a respiration equipment outlet to the environment, carbon dioxide sensor means connected to said respiration gas inlet for sensing carbon dioxide content of gas passing into said breathing mask at said gas inlet, and valve control means connected to said carbon dioxide sensor and including an actuator connected to said air distributing valve, said valve control means for controlling said air distributing valve to direct exhaled air from said respiration gas outlet to the environment when a carbon dioxide content in inhaled air at said respiration gas inlet is above a predeterminable limit value and to direct exhaled air from said respiration gas outlet to said breathing bag when said carbon dioxide content is below said limit value.

* * * * *